United States Patent [19]

Lautenschläger

[11] Patent Number: 5,039,181

[45] Date of Patent: Aug. 13, 1991

[54] SYSTEM FOR FASTENING THE TRACK OF A DRAWER SLIDE

[75] Inventor: Horst Lautenschläger, Reinheim, Fed. Rep. of Germany

[73] Assignee: Karl Lautenschläger GmbH & Co. KG, Reinheim, Fed. Rep. of Germany

[21] Appl. No.: 413,373

[22] Filed: Sep. 27, 1989

[30] Foreign Application Priority Data

Sep. 27, 1988 [DE] Fed. Rep. of Germany ..... 3832701

[51] Int. Cl.[5] ..... A47B 88/00

[52] U.S. Cl. ..... 312/343; 248/298; 312/341.1

[58] Field of Search ..... 312/344, 343, 330.1, 312/341.1, 342, 338, 345, 346, 347; 248/224.3, 297.3, 298, 257, 259, 258, 265, 271

[56] References Cited

U.S. PATENT DOCUMENTS

| | | | |
|---|---|---|---|
| 1,193,403 | 8/1916 | Little | 248/258 |
| 1,487,911 | 3/1924 | Bayok | 248/271 |
| 3,675,883 | 7/1972 | Holmes et al. | 312/343 |
| 3,750,993 | 8/1973 | Read | 248/298 |
| 4,278,309 | 7/1981 | Dreiling | 312/345 |

*Primary Examiner*—Kenneth J. Dorner
*Assistant Examiner*—Gerald A. Anderson

[57] ABSTRACT

System for fastening the inside, rear end of the track of a guide for drawers and the like, inside of a cabinet at a distance from the inside surface of the associated side wall of the cabinet. A tongue is bent from the inside end of the track at right angles to the length of the track. The tongue is associated with a fitting which can be fastened inside of the cabinet and into which the tongue can be fitted horizontally and in which the tongue can be set by detents at selected locations.

18 Claims, 6 Drawing Sheets

FIG. 2
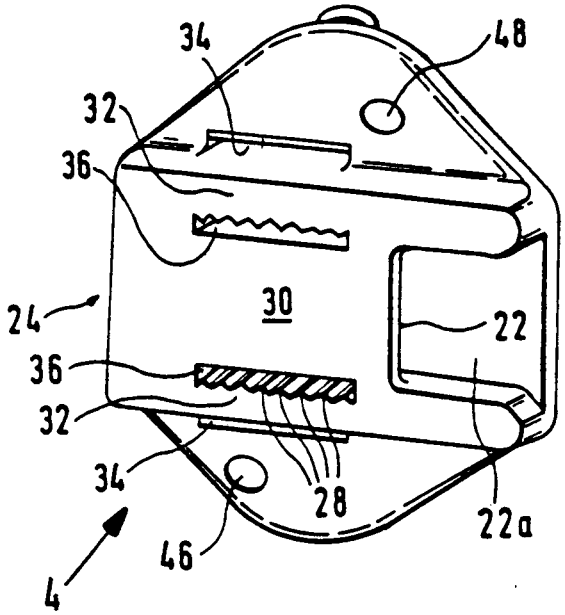
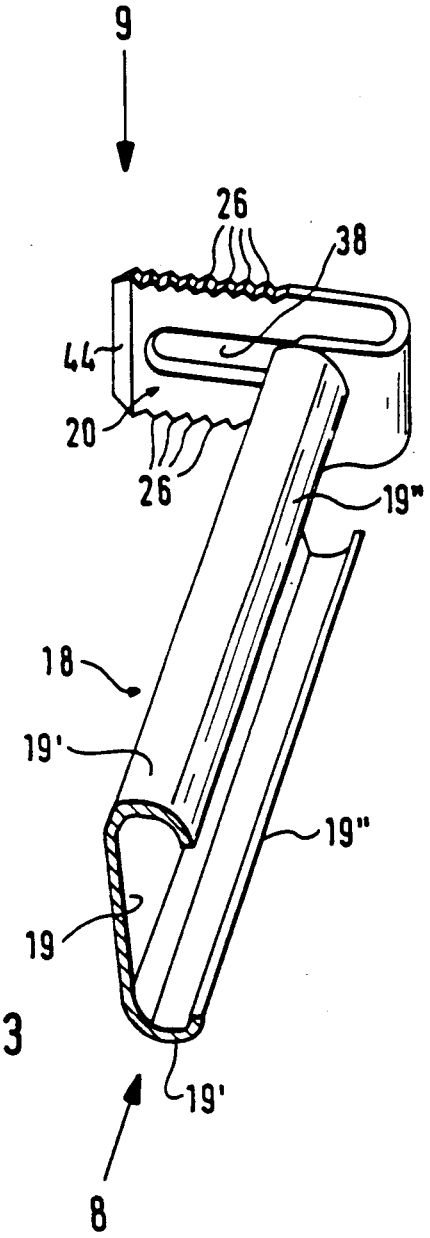
FIG. 3

FIG. 4
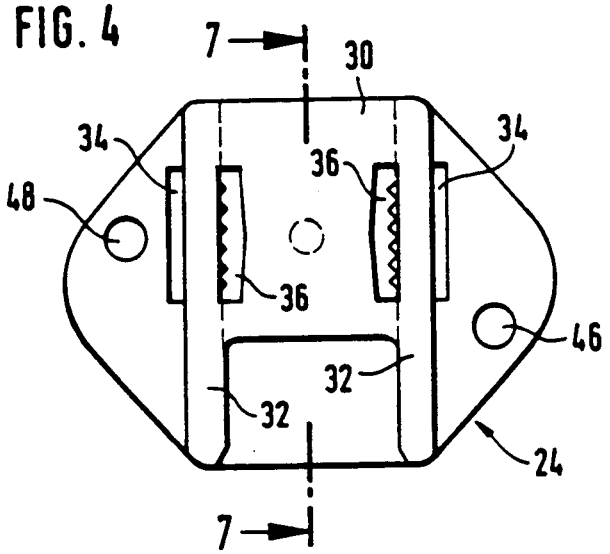
FIG. 7
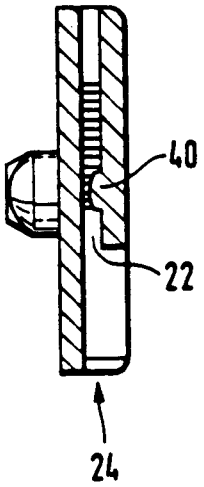
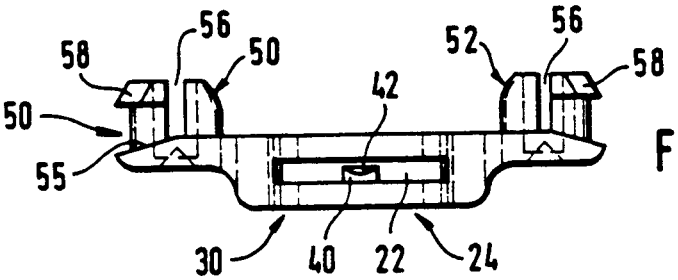
FIG. 5
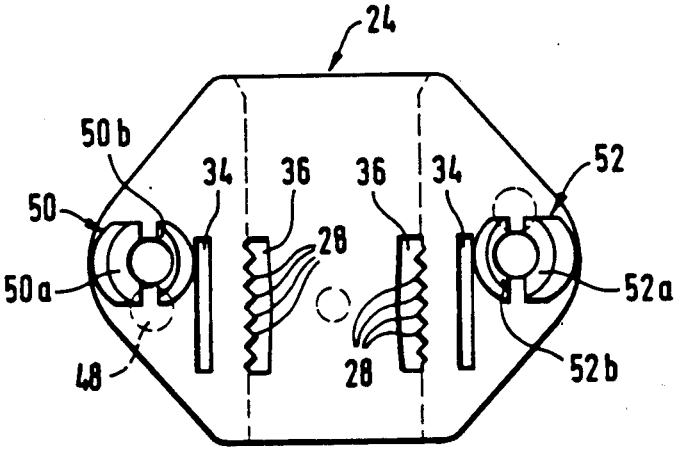
FIG. 6

SYSTEM FOR FASTENING THE TRACK OF A DRAWER SLIDE

BACKGROUND OF THE INVENTION

The invention relates to a system for fastening the cabinet-interior, rearward end of the track of a slide for drawers or the like, in the carcase of a cabinet, at a distance from the inside surface of the lateral wall of the cabinet.

The tracks of slides by means of which drawers, pull-out boards, appliance holders and the like are mounted in a cabinet so as to enable them to be drawn out and pushed in again are normally screwed directly onto the inside surface of the associated cabinet side wall. In the case of certain cabinet types produced mostly by kitchen cabinet manufacturers in and for the United States of America, however, the front opening of the cabinet is narrowed by a circumferential face frame; as a result, drawers or other pull-outs can have a width corresponding only to the clear width between the vertical edges of the frame. In this case the track of the drawer guide cannot be fastened to the cabinet side wall but must be shifted toward the cabinet interior by the amount by which the frame reaches past the inside surface of the associated cabinet side wall. The front end of the track is in that case screwed in an appropriate manner to the inside surface or to the edge of the frame, while its inside, rearward end must be fastened to the rear wall of the cabinet. Even in the mounting of plastic drawers with hollow side walls or in the mounting of drawers below their bottom and within their sides extending below the bottom, the track has to be mounted at a distance from the associated side wall of the cabinet.

It is the purpose of the invention to create a system for fastening the inside, rearward end of the track of a drawer guide to the rear wall of the cabinet, which will permit a simple and quick horizontal adjustment of the position of the inside track end in order thus to be able to compensate any possible inaccuracies in the manufacture of the cabinet or changes in the inside dimensions of the cabinet in the course of time due to external influences such as atmospheric humidity.

SUMMARY OF THE INVENTION

Setting out from a fastening system of the kind referred to above, this purpose is accomplished in accordance with the invention by the fact that a tongue bent at right angles to the length of the track is provided at the inside end of the track, and that with the tongue there is associated a fitting which can be fastened in the cabinet interior and has a socket adapted to the tongue, into which the tongue can be inserted horizontally so as to be able to be held by detents in selected positions.

In a preferred further development of the invention, the tongue is provided, on at least one of its horizontal outer edges, preferably on its top and bottom horizontal edges, with detent serrations, complementary serrations being formed on the walls of the socket that are associated with the serrations on the tongue, and the portions of the fitting that are provided with the complementary serrations are made to be elastically resilient by such an amount that the position of the tongue in the socket can be fixed by exerting a horizontal pressure in the longitudinal direction of the tongue so as to catch in steps corresponding to the pitch of the teeth.

In a preferred further development of the invention the tongue can have a longitudinal slot which is engaged by a pin protruding from one side of the socket in the fitting, the diameter of the pin corresponding substantially to the width of the slot. The pin engaging the slot thus determines the precise position of the tongue and thus of the inside end of the track.

The configuration is best made such that, when the tongue is properly set in the socket, the pin engaging the slot in the tongue projects integrally from the inside surface of the fitting socket toward the rear wall of the cabinet, but passes only partway through the slot, and such that the portion of the fitting that bears the pin can yield resiliently. The resiliency of the socket wall bearing the pin thus permits the tongue to be pushed into the socket while the pin snaps into the slot in the tongue.

The resilient flexing of the socket wall bearing the pin is facilitated whenever the pin and/or the tongue is provided with a ramp at its free end. As soon as the pin engages the slot, the length of the slot determines the length of the horizontal displacement of the tongue in the fitting, as the pin encounters the ends of the slot.

While the tongue as a rule consists of metal—at least when it is integral with the track--the fitting is preferably a one-piece injection-molding of plastic.

The fitting itself, in a preferred further development of the invention, has a flat flange which can be attached to the rear wall of the cabinet, and which bears a thicker socket section containing the socket for the tongue, which is disposed parallel to the rear wall of the cabinet.

When the fixing of the tongue in the socket is accomplished by the above-mentioned detent serrations, the margins of the fitting that bear the serrations are best formed on horizontal, bridge-like sections, the top and bottom sections being formed by transversely running slots passing through the fitting. The bridge-like sections are then made of such dimensions that they can flex to a sufficient extent, when the tongue is pressed into the socket, to enable the detent serrations on the tongue to jump over the serrations in the socket.

The fitting can be fastened to the rear wall of the cabinet—if the rear wall is made of sufficiently thick material—by screws. Alternatively, the fitting can have fastening posts projecting from the side of the fitting that faces the rear wall of the cabinet, these posts being inserted into perforations in the rear wall.

In a desirable further development of the invention, the configuration can be such that the fitting has substantially the same horizontal width as the flat flange, and that a portion of the wall of the socket section defining the socket is cut away from a vertical edge of the flat flange in a width corresponding to the free height of the socket. In the cut-away area therefore the socket is open at the front side, while walls defining the top and bottom continue to be present and form surfaces to guide the tip of the tongue.

The configuration of the fitting can be made such that the flat flange projects upward and downward beyond the top and bottom of the socket section, in which case it is desirable that fastening posts project, one from the top and one from the bottom portion of the back of the flat flange.

If the fitting is to be fastened on a relatively thin cabinet back having perforations to receive the fastening posts, a configuration is recommended in which two fastening posts are provided, which are divided each into two resilient halves by a slot running from their free ends, and which have each a catch projection extending radially from the free end of one of the post halves at a distance from the back of the fitting that corresponds to the thickness of the cabinet's back wall. That is to say, the fitting is installed by pressing the fastening posts into the associated perforations. The two resilient halves of each fastening post are squeezed together resiliently as the outwardly extending catch projections are forced through the perforations, but then snap back apart as soon as the proper installation position is reached. The catch projections then caught on the edge of the perforation secure the fastening posts against withdrawal from the perforation and thus secure the fitting against removal from the cabinet's rear wall.

The halves of the fastening posts, which, as the catch projections pass through the corresponding perforations in the rear wall, are squeezed resiliently together, and/or the catch projections themselves, are best tapered conically toward their free ends in order to facilitate the location of the perforations and the passage of the fastening pins through them.

The fitting can be provided in the area of the slotted fastening posts with a through-bore into which the shaft of a fastening screw can be driven which prevents the post halves from being squeezed resiliently together when the fitting is in the installed state on the rear wall of the cabinet. These through bores therefore permit additional securing of the fastening posts in the perforations in the cabinet's rear wall.

Instead of the fitting being fastened to the rear wall of the cabinet, it can be fastened to the side wall of the cabinet, in which case its configuration is made such that the fitting has a fastening portion which can be fastened on the cabinet wall, from which a socket portion extends parallel to the cabinet's rear wall toward the drawer guide track and contains the socket for the tongue. The fastening portion can either be screwed to the cabinet side wall, or, as in the fitting previously described, it can be held on the cabinet side wall by fastening posts engaged in perforations in the cabinet side wall.

If roller drawer guides are used for mounting drawers or other extendable cabinet parts, tracks of two different kinds are sometimes used on the opposite sides of the drawer, one being so configured that it not only has flanges reaching at right angles into the cabinet interior and forming the race for the roller provided on the drawer runner, but also these flanges have additional, recurved portions reaching around and cradling the runner roller and extending over the entire length of the track, which prevent the runner roller from slipping laterally off the flanges. But on the flanges of the second track such recurved portions cradling the runner roller cannot be provided, since otherwise binding and dragging of the drawer can occur if the dimensions and inside width of the cabinet differ from the dimensions specified. The latter track is therefore provided with wider flanges on which the roller of the runner can shift transversely without interference. The tracks provided for the fastening system are thus adjustable to a considerable degree in the fitting at their cabinet-interior ends, in the described manner, so that it is conceivable that the inner ends of the tracks of a pair of drawer guides might be adjusted contrariwise each toward its corresponding side wall to such an extent that the runner roller rolling on the track provided with flat flanges might slip laterally beyond the free edge of this flange and the drawer might drop on this side. This is prevented in accordance with the invention by the fact that, of the two tracks of a pair of drawer guides to be provided on opposite sides of a drawer, the one is configured in the described manner such that it has the additional flange reaching around the roller of the corresponding runner, while in the other track such additional flanges are provided only in the cabinet-interior end area, while the flanges otherwise are flat over the greater part of their length, i.e., they permit lateral adjusting movements of the corresponding runner roller. This brings it about that, when making an adjustment from above, of closed drawers mounted in a cabinet with the fastening system of the invention, with the cabinet top removed, a transverse alignment of the inside end of the drawer will automatically result in a corresponding transverse adjustment of both guide ends relative to the corresponding fitting, because the rollers which, when the drawer is closed, are situated at the rear end of the track, both of them are cradled by the recurved flanges of the tracks, i.e., the rollers and the tracks interlock. This interlock is interrupted when the drawer is drawn out of the cabinet as soon as the runner roller passes over onto the flat flanges of the second track.

BRIEF DESCRIPTION OF THE DRAWINGS

The invention will be further explained in the following description of several embodiments, in conjunction with the drawing, wherein:

FIG. 2 is a perspective view of the fitting that serves to connect the drawer guide track to the back of the cabinet, FIG. 3 is a perspective view of the cabinet-interior, rearward end of the track that is to be fastened in the fitting shown in FIG. 2, FIG. 4 is a view of the fittinq as seen in the direction of the arrow 4 in FIG. 2, FIG. 5 is a side view of the fitting shown in FIG. 4, FIG. 6 is a rear view of the fitting of FIGS. 4 and 5, FIG. 7 is a cross section of the fitting, as seen in the direction of the arrows 7—7 of FIG. 4.

DESCRIPTION OF PREFERRED EMBODIMENTS

Figure 1:
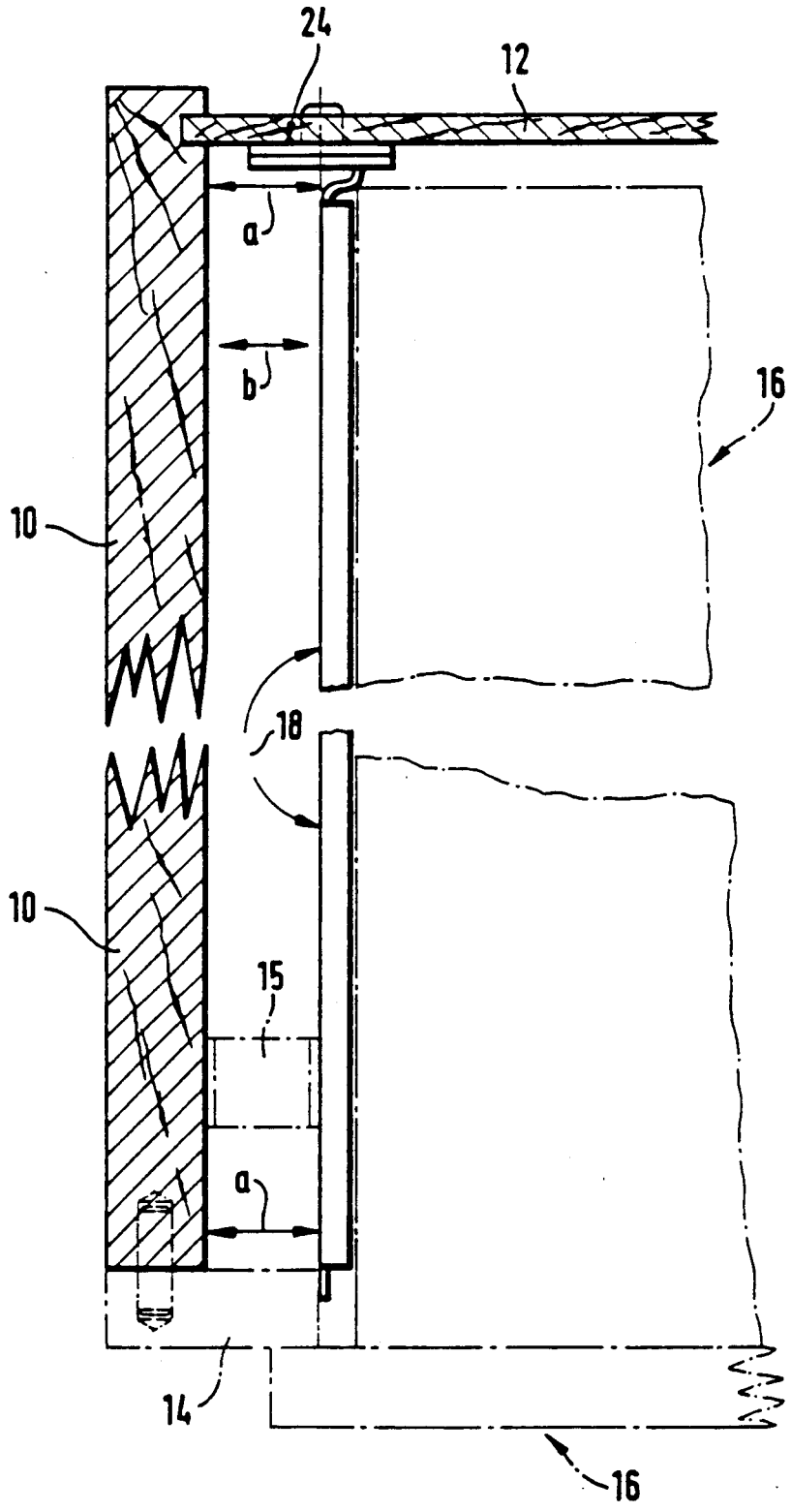
FIG. 1 is a diagrammatic horizontal section through a lateral portion of the carcase of a drawer cabinet whose front opening is narrowed by an overlaid frame, the fastening for a track of an associated drawer is represented diagrammatically.

FIG. 1 shows a horizontal section through the left side portion of a cabinet, including the left lateral wall 10, the relatively thin rear wall 12, and a stile 14 of the frame fastened on the front edge of the lateral wall 10 and narrowing the front inside width of the cabinet. In this cabinet drawers are to be installed of which one drawer 16 is indicated in broken lines. It can be seen that the portion of drawer 16 that lies within the cabinet in the closed state must have a width that is less, by at least twice the dimension a by which the stile 14 reaches beyond the inside surface of the lateral wall 10, than the inside distance between the lateral walls 12 of the cabinet, i.e., that the track 18 of the left drawer guide, which is to be affixed to the cabinet, has to be mounted in the position shown, at a distance from the lateral wall 10. Such fastening at the distance a from the lateral wall may also be necessary even if no stile 14 is narrowing the cabinet opening, but a plastic drawer with hollow sides is to be installed and the drawer guide is to be mounted in the cabinet inside of these hollow drawer sides. The arrangement of the drawer guide below the drawer bottom and inside of the drawer side projecting downward from the bottom requires that the track be fastened at a distance from the lateral wall of the cabinet. The front end of the track in that case is either, as indicated, fastened to the free edge or to the back of the stile 14 or, if no stile 14 is present, it is fastened on a separate support 15, while its cabinet-interior, rearward end must be fastened on the inside face of the rear wall 12 of the cabinet. The invention relates to this fastening of the rearward end of the track 18 to the rear wall of the cabinet, and the fastening system is to be arranged such that the inner end of the track 18 will be adjustable horizontally in the direction of arrows b in order thereby to be able to compensate for inaccuracies in the manufacture of the cabinet, or for later distortion due to ambient influences.

For this purpose, the track 18 (FIGS. 3, 8 and 9) has on its rearward end a tongue 20 bent at right angles from its web 19. This tongue can be inserted into a socket 22 in a fitting 24 (FIGS. 2 and 5 to 7) and can be locked in the socket 22 at selected positions. Furthermore, the track 18 has flange portions 19′ bent from the top and bottom margins of its web 19, which form the races for the rollers (not shown) of the associated runner provided on the drawer, and which are integral with a hook portion 19″ running along the entire length of the flange 19′ and reaching behind the above-mentioned rollers at the top and at the bottom.

The tongue 20 is provided on its upper and lower horizontal edges with uniformly distributed, pointed detent serrations 26, with which complementary upper and lower detent serrations 28 in the fitting 24 are associated.

The fitting 24 is, in the case represented, a plastic part manufactured by the injection molding method which has the shape of an elongated flange fitting which can be mounted vertically on the rear wall of the cabinet. In its central part it has a thicker section 30 projecting out of the carcase interior and containing the receiver socket 22 projecting outwardly from the cabinet interior parallel to the back wall of the cabinet. The margins provided with the detent serrations are formed on horizontal bridge-like sections 32 which are created at their upper side and lower side by transversely disposed slots 34 passing through the fitting 24. Since these slots 34 and 36 pass all the way through the fitting, the above-mentioned horizontal, bridge-like section 32 is left between them, which has the resilient deformability necessary for the detent adjustment. It can be seen from FIGS. 2, 4 and 7 that, in the fitting 24, a portion of the socket 22 is cut away in the manner indicated at 22*a* on the front-defining wall of holding section 30, so that the socket 22 in the cut-away portion is open at the front for the tilt-proof engagement of the tongue 20.

To limit the adjusting movement of the tongue 20 within the socket 22, the tongue 20 is provided with a horizontal slot 38 which is to be engaged by a pin 40 (FIG. 5) protruding from the inside surface of the front wall of holding section 30, whose diameter substantially corresponds to the width of slot 38. The pin 40 does not pass completely through the socket 22, as it can be seen in FIG. 5, and furthermore it has at its free end a ramp 42 which is associated with a complementary ramp 44 on the free front end of the tongue 20. When the tongue 20 is inserted into the socket 22, therefore, the ramp 44 runs onto the ramp 42 and the wedging action thereby exerted causes the front wall of holding section 30 bearing the pin 40 to flex resiliently outwardly, so that the pin 40 can pass through the solid front edge of tongue 20 into the slot 38, and then the front wall of holding section 30 snaps resiliently back.

The fitting 24 can be fastened to the rear wall 12 of the cabinet by screwing it thereto, if the wall has the necessary thickness. The lower hole 46 and the upper hole 48 seen in FIG. 2 could serve for this purpose. Since, however, relatively thin material is often used in the rear walls 12, simply screwing the fitting 24 to the rear wall 12 would not result in a sufficiently strong fastening. In the fitting 24 intended for such a thin rear wall 12, therefore, two posts 50 and 52 situated at different levels from one another are provided, which protrude from the back of the fitting confronting the wall, and which can be pushed through associated perforations (not shown) in the rear wall 12. The position of the posts 50 and 52 is selected such that the distance between their central axis from the inside surface of the lateral wall 10 is equal to the distance a, i.e., to the amount by which the stile 14 projects beyond the inside surface of the lateral wall.

The mounting posts 50 and 52 are divided by a vertical slot 56 into two resilient halves 50*a*, 50*b*, and 52*a*, 52*b*, respectively, each half having a radially outwardly projecting catch projection 58 at a distance from the back of the fitting corresponding to the thickness of the rear wall 12. These catch projections 58, and also the adjacent front ends of the post halves 50*a*, 50*b* and 52*a*, 52*b*, are tapered in the direction of their free ends, so that, when the bottom end of the fitting is pressed against the rear wall 12, the post halves are squeezed together resiliently as they pass through the associated perforation in the rear wall 12. In the proper mounting position, in which the back of the fitting 24 lies against the inside surface of the rear wall 12, the post halves then snap back apart and the catch projections 58 catch on the margin of the associated perforation. The fitting 24 is accordingly secured against withdrawal from the associated perforation in the rear wall 12 also in the area of its lower post 52.

If necessary, the fitting 24 can additionally be secured by screws driven into the perforations 46 and 48 described above as simple mounting holes. It is apparent that the holes 46 and 48 are so disposed that they open within slot 56 of the mounting posts 50 and 52. Consequently, the shank of a screw driven through them will prevent the post halves 50*a*, 50*b*, and 52*a*, 52*b*, from being squeezed resiliently together as they would have to be for the removal of the fitting.

Figure 10:
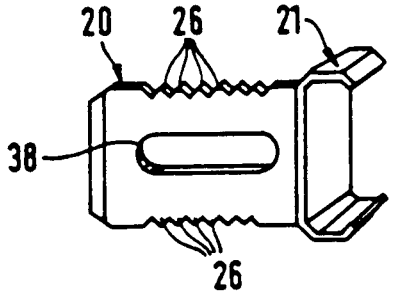
FIG. 10 is a perspective view of a tongue which can be retrofitted to a normal drawer guide track.

In FIG. 10 the tongue 20 is not integral with a corresponding track but is provided on a separate clip 21 which can be fitted onto the cabinet-interior end of a normal track, i.e., one not provided with an integral tongue, in which case the clip 21 is fastened to the track either by being of such dimensions that it grips the track with spring bias or it is fastened by means of additional set screws or the like contained in taps in the clip 21 and driven against the track. The tongue 20 itself is the same as the tongue described above, which is integral with the track 18, so that another description of the tongue is unnecessary.

FIGS. 11 to 14 each show modified embodiments of fittings which, as regards the adjustable retention of the tongue 20 in the socket 22, correspond functionally to the fitting described in connection with FIGS. 2 and 4 to 7, so that all that will be discussed below will be the variations in the way they are fastened in the cabinet.

Figure 11:
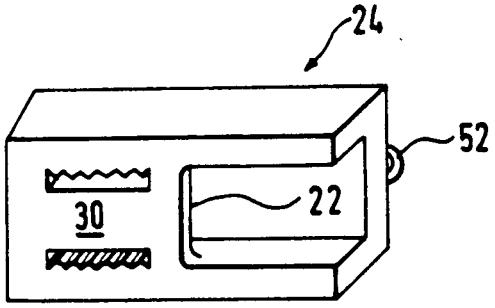
FIG. 11 is a perspective view of a second embodiment of a fitting which can be fastened to a rear wall of a cabinet.

In the case of the fitting 24 shown in FIG. 11, there are no flanges projecting beyond the holding section 30, so that the mounting posts, of which only one post 52 is indicated in the drawing, are disposed in horizontal alignment at a distance apart, approximately centrally in the bottom of the holding section 30.

Figure 12:
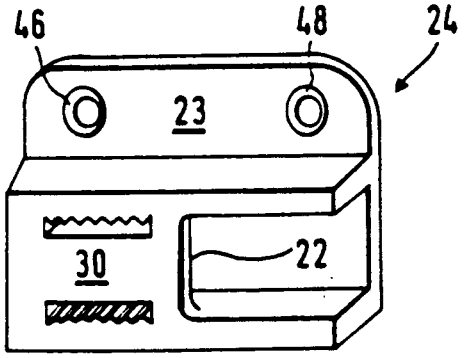
FIG. 12 is a perspective view of a fitting slightly different from the one in FIG. 11, which is also intended to be mounted on the back wall of a cabinet.

The fitting 24 shown in FIG. 12 differs from the embodiment described in connection with FIGS. 2 and 4 to 7 in that the flanges extend beyond the holding section 30 only at the top in the form of an oblong flange 23 in which two mounting perforations 46 and 48 are provided at a lateral distance apart to enable the fitting to be screwed onto the side wall 12 of the cabinet. If this fitting is to be fastened on a thin rear wall 12, mounting posts not shown, corresponding to posts 50 and 52, can be provided.

Figure 13:
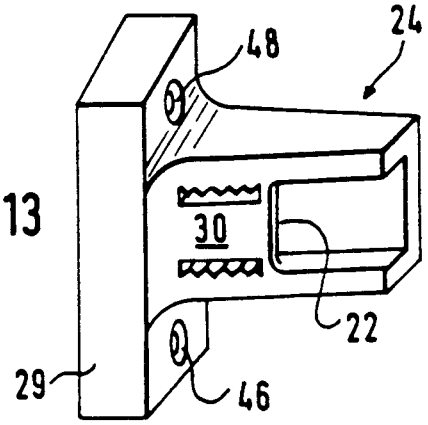
FIG. 13 is a perspective view of a fitting intended for fastening to the side wall of a cabinet.

FIG. 13 shows a fitting 24 which is designed to be suitable for fastening to the side wall 10 of the cabinet instead of the rear wall 12. Accordingly, the socket section 30 projects centrally and at right angles from the mounting section 29 that is to be fastened to the side wall 10 and is provided with the holes 46 and 48 for screws by which the mounting section 29 can be affixed to the cabinet side wall 10. Since this fitting 24 is made symmetrical with a plane passing horizontally through the center of the fitting, it is equally suitable both for fastening right-hand and left-hand tracks.

Figure 14:
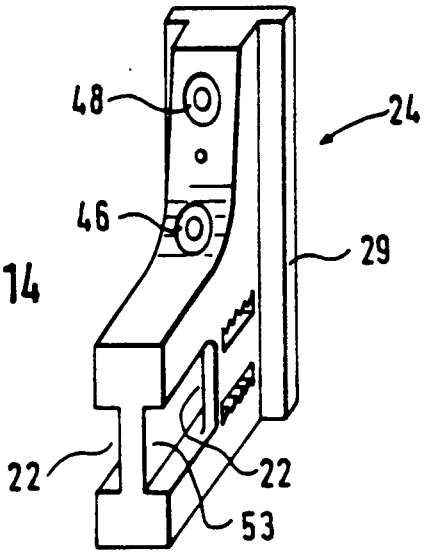
FIG. 14 is a perspective view of a fitting also intended for mounting on the cabinet side wall, which is a modification of the fitting shown in FIG. 13.

The same applies to the socket fitting 24 shown in FIG. 14, which is provided for mounting on the cabinet side wall 10. Although it does not project centrally from the associated mounting section 29 but from its bottom portion and accordingly has no symmetry about a horizontal plane, it is nevertheless suitable for right-hand and left-hand mounting, since it is symmetrical with a vertical plane parallel to the rear wall. In contrast to the fitting thus far described, this embodiment, however, has two parallel sockets 22 separated by a dividing wall 53. The socket 22 that is on the front when the fitting is fastened to the right or left side wall 10 of the cabinet will then serve for the insertion of the tongue 20 of the track 18 that is to be installed.

Figure 8:
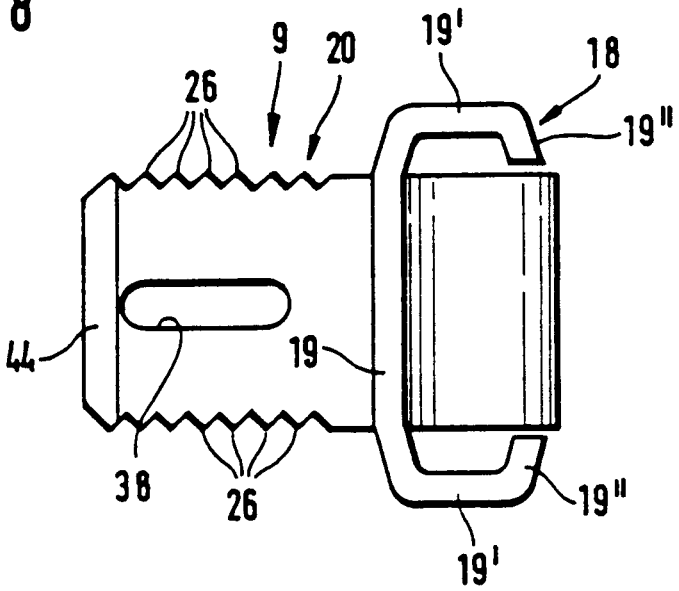
FIG. 8 is a front end view of the track as seen in the direction of arrow 8 in FIG. 3.
Figure 9:
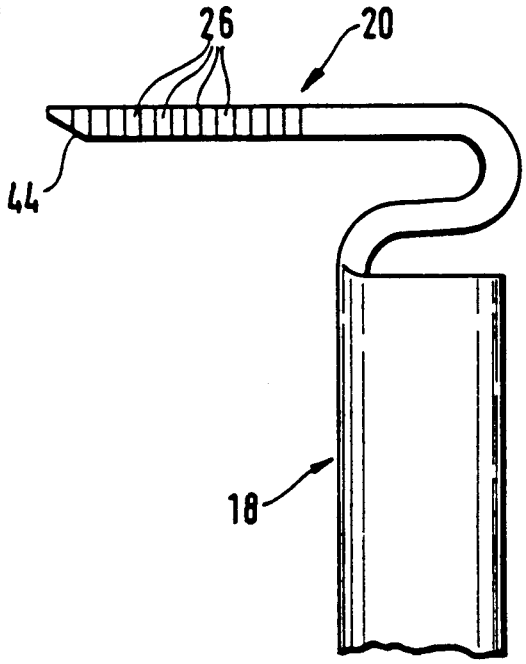
FIG. 9 is a view of the rearward end of the track as seen in the direction of arrow 9 in FIG. 8.
Figure 15:
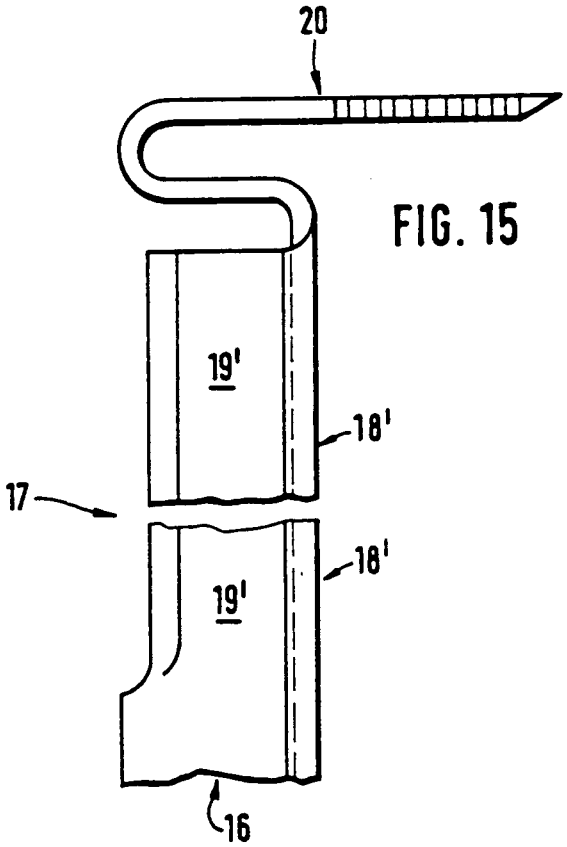
FIG. 15 is a top view of the cabinet-interior, rearward end of a track which is a modification from the track shown in FIGS. 8 and 9.
Figure 17:
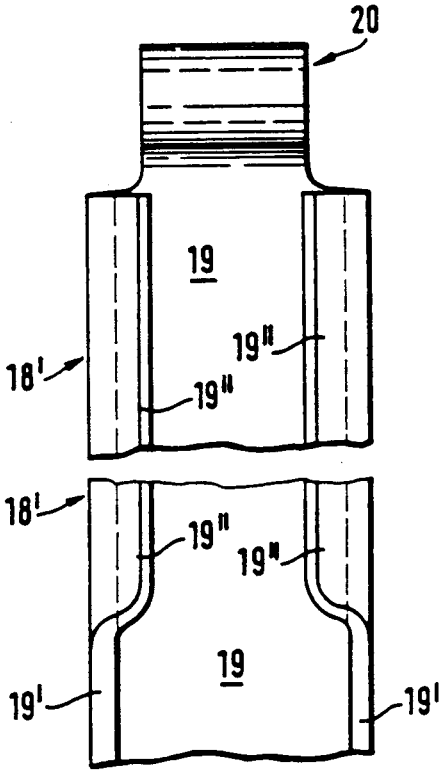
FIG. 17 is a view of the modified track as seen in the direction of arrow 17 in FIG. 15.
Figure 16:
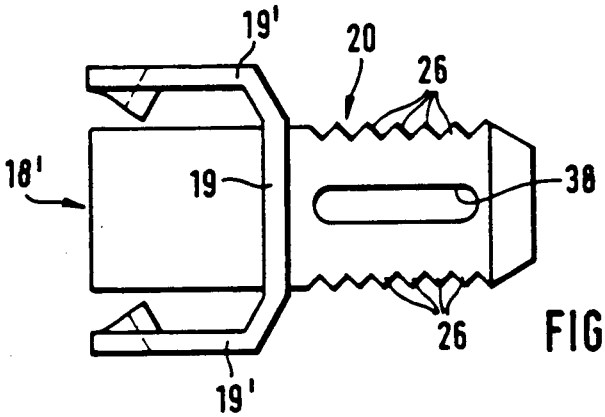
FIG. 16 is a view of the modified track as seen in the direction of arrow 16 in FIG. 15.

In FIGS. 15 to 17 there is shown a track 18' which is different from the track 18 described in connection with FIGS. 3, 8 and 9, but is best used paired with a track 18. Unlike the track 18, the flange sections 19'' cradling the roller of the corresponding runner are provided on the margins of flange sections 19' only toward the rear end of track 18'. In other words, these recurving flange sections 19'' do not extend over the entire length of the flange sections 19'. The roller of the associated runner is therefore cradled by the flange sections 19'' only when the drawer has been pushed at least largely into the cabinet. That is to say, during the greater part of the drawer travel, lateral shifting of the roller of the runner associated with the track 18' is permitted on the flat flange sections 19'. Not until the drawer approaches the fully closed state does the roller of the runner pass between the flange sections 19'' and the flange section 19, thereby bringing it about that the tracks 18 and 18' of a pair which serve to mount a drawer and are situated in front of opposite side walls 10 of a cabinet are adjusted in their distance apart to correspond to the distance between the rollers of the runners of the drawer. Furthermore, when the drawer is closed and the top or working surface of the cabinet is raised, it is possible to perform a simultaneous transverse adjustment of the mounting of the cabinet-interior ends of both tracks 18 and 18' from above by shifting the inner end of the drawer transversely. Otherwise the track 18' represented in the drawings is the same as track 18, so that to this extent it is sufficient to consult the description of track 18.

It is evident that modifications and further developments of the embodiments described can be achieved within the scope of the spirit of the invention, relating on the one hand to the precise configuration of the fitting 24 as regards its fastening to the cabinet rear wall 12 or side wall 10, and on the other hand to the configuration and arrangement of the socket 22 in the fitting, as well as the configuration and arrangement of the tongue 20 of a corresponding track. All that is essential for the invention is that the cabinet-interior ends of tracks are mountable at a distance from the adjacent cabinet side wall, for transverse displacement horizontally.

I claim:

1. A system for fastening a cabinet-interior, rearward end of a track of a pull-out guide for drawers in a carcase of a cabinet having interior side and rear walls, said fastening occurring a distance from an inside surface of an associated carcase side wall, comprising:

a tongue located at a carcase-interior end of the track, said tongue being bent at right angles to the length of the track and parallel to the cabinet rear wall, and a fitting associated with said tongue, said fitting fastened to a carcase interior wall and having a socket receiving said tongue, said tongue having a free end which can be inserted into said socket for transverse displacement in the horizontal direction and for locking in selectable displacement positions;

said tongue further including top and bottom horizontal edges, at least one of said edges having detent serrations, said socket having walls formed with detent serrations complementary to and associated with the detent serrations of said tongue, said complementary detent serrations of said walls of said fitting being resiliently flexible to allow displacement of said tongue in the socket by exerting a horizontal pressure in a direction parallel to the edges of said tongue catching in steps corresponding to a pitch of the detent serrations.

2. System for fastening of claim 1, characterized in that the tongue has a slot running in the direction of displacement, into which a pin protruding from one of the associated walls of the socket of the fitting engages, whose diameter corresponds substantially to the width of the slot.

3. System for fastening of claim 2, characterized in that the pin engaging the slot of the tongue projects integrally toward the cabinet rear wall from the inner surface of the wall of the fitting which overlaps the tongue on the carcase-exterior front side in the properly installed position, and at the same time only partially passes through the socket, and that the wall of the fitting bearing the pin is made resiliently deformable out of the carcase interior in the horizontal direction.

4. System for fastening of claim 3, characterized in that the pin and/or the tongue have ramps.

5. System for fastening of any one of claims 1 or 2, characterized in that the tongue is an integral part of the track.

6. System for fastening of any one of claims 1 or 2, characterized in that the tongue is provided on a separate tongue holder which can be fastened to the track in the cabinet-interior, rearward end area of the track.

7. System for fastening of any one of claims 1 or 2, characterized in that the fitting is made in one piece from plastic.

8. System for fastening of claim 7, wherein the mounting section bearing the detent serrations is formed with horizontal bridge-like sections which are formed by transversely running slots passing through the fitting.

9. System for fastening of any one of claims 1 or 2, characterized in that the fitting has a flange plate mountable on the cabinet rear wall, the flange plate having a mounting section projecting in the direction out of the carcase interior, through which the socket for the tongue passes in the transverse direction parallel to the cabinet rear wall.

10. System for fastening of claim 9, wherein of the mounting section bearing the detent serrations is formed with horizontal bridge-like sections which are transversely running slots passing through the fitting.

11. System for fastening of claim 9, wherein in that the mounting section has substantially the same horizontal width as the flange plate, and that a portion of the mounting section is cut away in a width corresponding to the clear height of the tongue.

12. System for fastening of claim 9, wherein in that the flange plate extends upward and downward beyond the upper and the lower limit of the mounting section of the fitting, and that one fastening post projects from the upwardly extending flange plate and a second fastening post projects in the downwardly extending flange plate from the back from the back of the flange plate.

13. System for fastening of any one of claims 9 or 10, in which the fitting is fastened on a relatively thin cabinet rear wall provided with perforations to accommodate two fastening posts, wherein in that said two fastening posts are provided, projecting from the fitting at a distance apart from one another, and each part is by a slot running from a free end of each part into two resilient post halves, each of the post halves a catch projection extending radially from the free end.

14. System for fastening of claim 13, wherein in that the post halves forming the fastening posts are made resilient in such a manner that, when the catch projections pass through a corresponding perforation in the rear wall, they can be resiliently squeezed together, and that the post halves taper conically in the direction of their free end.

15. System for fastening of claim 13 wherein in that the slotted fastening posts with are provided a through bore into which the shaft of a fastening screw can be threaded, which prevents the post halves from being resiliently squeezed together when the fitting is installed on the cabinet rear wall.

16. System for fastening of any one of claims 1 or 2, wherein in that the fitting has fastening posts projecting from a rear-wall-facing flat side, which can be inserted into mounting perforations in the rear wall.

17. System for fastening of any one of claims 1 or 2, wherein in that the fitting has a fastening section which can be fastened on the carcase side wall and from which a mounting section projects parallel to the carcase rear wall toward the track, in which the socket for the tongue is provided.

18. System for fastening of claim 14, wherein the slotted fastening posts are provided with a through bore into which the shaft of a fastening screw can be threaded, which prevents the post halves from being resiliently squeezed together when the fitting is installed on the cabinet rear wall.

* * * * *